US006935532B2

(12) United States Patent
Tinucci et al.

(10) Patent No.: US 6,935,532 B2
(45) Date of Patent: Aug. 30, 2005

(54) DUAL DILUENT POST-MIX BEVERAGE DISPENSER

(76) Inventors: Peter S. Tinucci, 696 Easy St., Glendale Heights, IL (US) 60139-3340; David W. Berend, 10105 Victor Pl., Algonquin, IL (US) 60102

( * ) Notice: Subject to any disclaimer, the term of this patent is extended or adjusted under 35 U.S.C. 154(b) by 0 days.

(21) Appl. No.: 10/404,505

(22) Filed: Mar. 26, 2003

(65) Prior Publication Data

US 2003/0183652 A1 Oct. 2, 2003

Related U.S. Application Data

(60) Provisional application No. 60/368,281, filed on Mar. 27, 2002.

(51) Int. Cl.[7] ..... B67D 5/00

(52) U.S. Cl. ..... 222/129.4; 222/145.1; 137/595; 251/149.9

(58) Field of Search ..... 222/129–129.4, 222/132, 145.5–145.8, 145.1, 144.5; 137/595, 884; 251/149.9

(56) References Cited

U.S. PATENT DOCUMENTS

2002/0084284 A1 * 7/2002 Landers et al. ..... 222/129.1

* cited by examiner

*Primary Examiner*—J. Casimer Jacyna
(74) *Attorney, Agent, or Firm*—Pyle & Piontek

(57) ABSTRACT

A system for delivering a selected one of two diluents to beverage dispensing valves is characterized by a manifold having a plurality of pairs of first and second diluent outlet orifices. One diluent is delivered to all of the first outlet orifices and the other diluent is delivered to all of the second outlet orifices. Hoses coupled at one end to diluent inlets to associated ones of the dispensing valves each have a connector at their opposite end which is adapted to be selectively and releasably connected with either the first or second orifice of an associated pair of orifices in accordance with whichever diluent is to be delivered by the hose to its associated dispensing valve. Stop plugs are releasably inserted into and close the non-selected orifices to prevent escape of diluent from those orifices. A retainer releasably retains the connectors and stop plugs in the orifices.

27 Claims, 11 Drawing Sheets

DUAL DILUENT POST-MIX BEVERAGE DISPENSER

This application claims the benefit of Provisional Application No. 60/368,281, filed Mar. 27, 2002.

FIELD OF THE INVENTION

The present invention relates generally to beverage dispensing equipment and more particularly to post-mix beverage dispensing equipment having the capacity to change between the dispensing of carbonated and non-carbonated drinks.

BACKGROUND

Post-mix beverage dispensing equipment is well known in the art and generally provides for the mixing of a diluent, consisting of carbonated or flat water, with flavoring syrup. Post-mix valves are secured to a dispenser body or frame to which a diluent water line and a syrup line are plumbed. In past dispensers, each valve was dedicated to either dispensing a carbonated or a non-carbonated drink. However, today there is great desire to have the flexibility to be able to change between dispensing carbonated drinks, such as soda pop, to noncarbonated drinks, such as juice and sports beverages with the same valve. Various attempts have been made to allow changeover between plain water and carbonated water lines so that each valve has the potential to dispense either carbonated or plain water based drinks. However, problems have arisen as to cost, mechanical complexity, lack of ability to be able to convert all the valves on a particular dispenser, and ease with which service personnel can effect the changeover. Accordingly, it would be very desirable to have a post-mix beverage dispenser that overcomes these drawbacks.

SUMMARY OF THE INVENTION

The present invention concerns a post-mix beverage dispenser having a plurality of beverage dispensing valves that are easily changed over between dispensing carbonated or non-carbonated drinks. In the preferred embodiment, a dual diluent manifold is mounted within the dispenser at a front end thereof. A plurality of post-mix beverage dispensing valves are mounted thereabove on a front surface of the dispenser. The manifold consists of an elongate rectangular block machined or molded to include a plain water channel and a carbonated water channel extending along the length thereof and along a bottom portion thereof. Each channel is in fluid communication with a plurality of holes or orifices that extend downward from a top surface of the manifold and transversely to their respective channel. Thus, there exist orifice pairs extending along the manifold, one of which fluidly communicates with the plain water channel and one of which communicates with the carbonated water channel. The plain and carbonated water channels have inlet ends for receiving fittings for connection with tubing that extends to cooled sources of plain and carbonated water respectively.

Water outlet fittings provide for quick insertion fluid tight connection of flexible water supply tubes to one of the plain or carbonated water orifices. The water supply tubes also have an inlet fitting on the opposite end thereof for fluid tight securing with an inlet that communicates diluent to each post-mix valve. Stop plugs provide for blocking any flow of water from the plain or carbonated water orifices that are not supplying diluent to a valve. A removable retaining means is used to hold each of the water outlet fittings and stop plugs in place so that the fluid tight securing thereof with each manifold orifice is maintained.

In operation, those of skill will understand that the retaining means can be released to permit service personnel to, for example, remove a water outlet fitting connected with a carbonated water orifice and to remove the stop plug from the corresponding plain water orifice. Each can then be exchanged with the other whereby the water outlet is now inserted into and retained in the plain water orifice and the stop plug is inserted into and retained in the carbonated water orifice. After replacing of the retaining means the particular post-mix valve formerly receiving carbonated water is now receiving plain water. In this manner, every post-mix valve on the dispenser is then fully capable of dispensing either carbonated or noncarbonated drinks. Moreover, the front end location of the manifold along with the easily inserted and removed water outlet fittings and stop plugs, and the easily removable and replaceable retaining means permit this change over to be done quickly and efficiently in the field. Those of skill will also appreciate that the manifold and associated components are simple and inexpensive to manufacture. Also, it can be understood that existing dispensers can be retrofitted with changeover devices of the present invention. Additionally, the present invention can be used with electrically cooled as well as ice cooled beverage dispensers.

DESCRIPTION OF THE DRAWINGS

A better understanding of the structure, function and operation as well as the objects and advantages of the present invention can be had by reference to the following detailed description that refers to the following figures, wherein.

DETAILED DESCRIPTION OF THE PREFERRED EMBODIMENT

Figure 1:
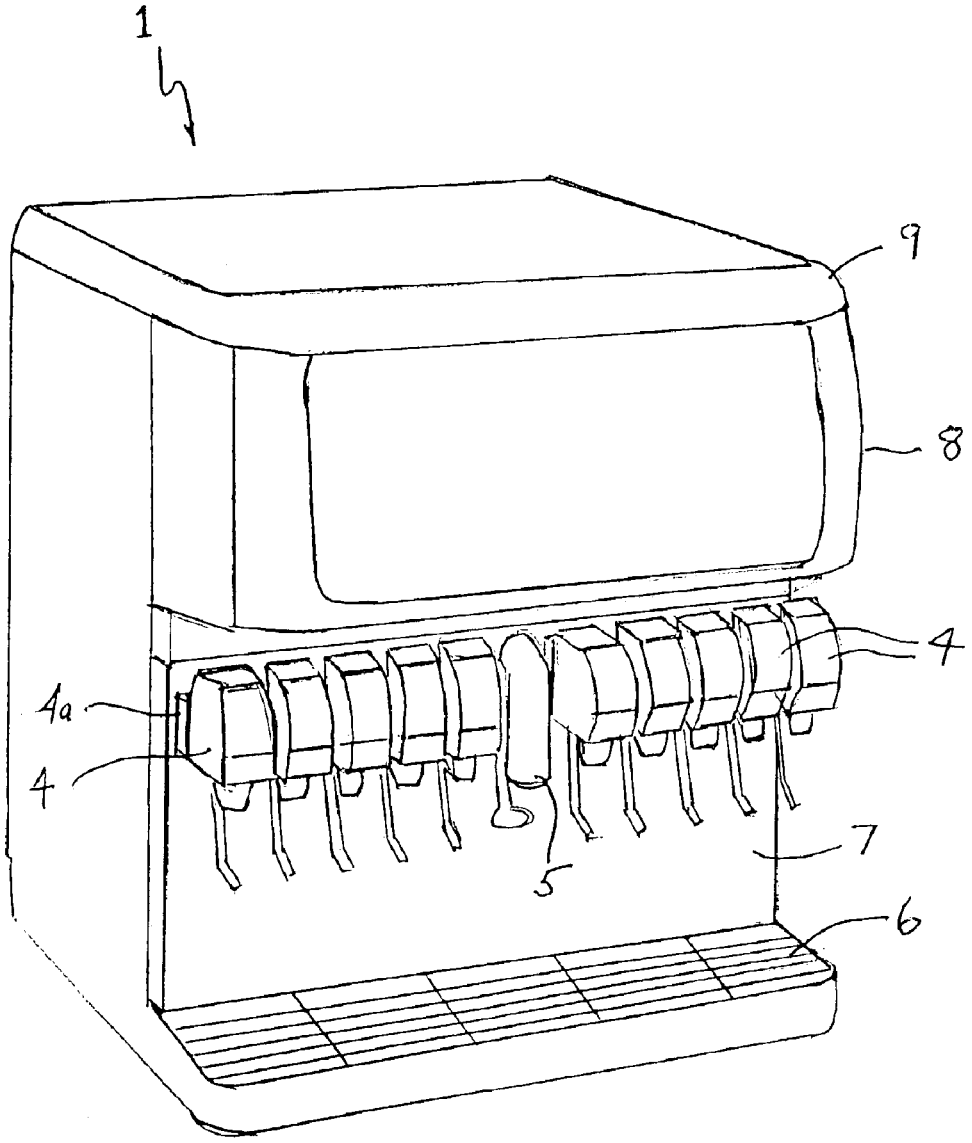
FIG. 1 shows a perspective view of a dispenser utilizing the present invention.
Figure 2:
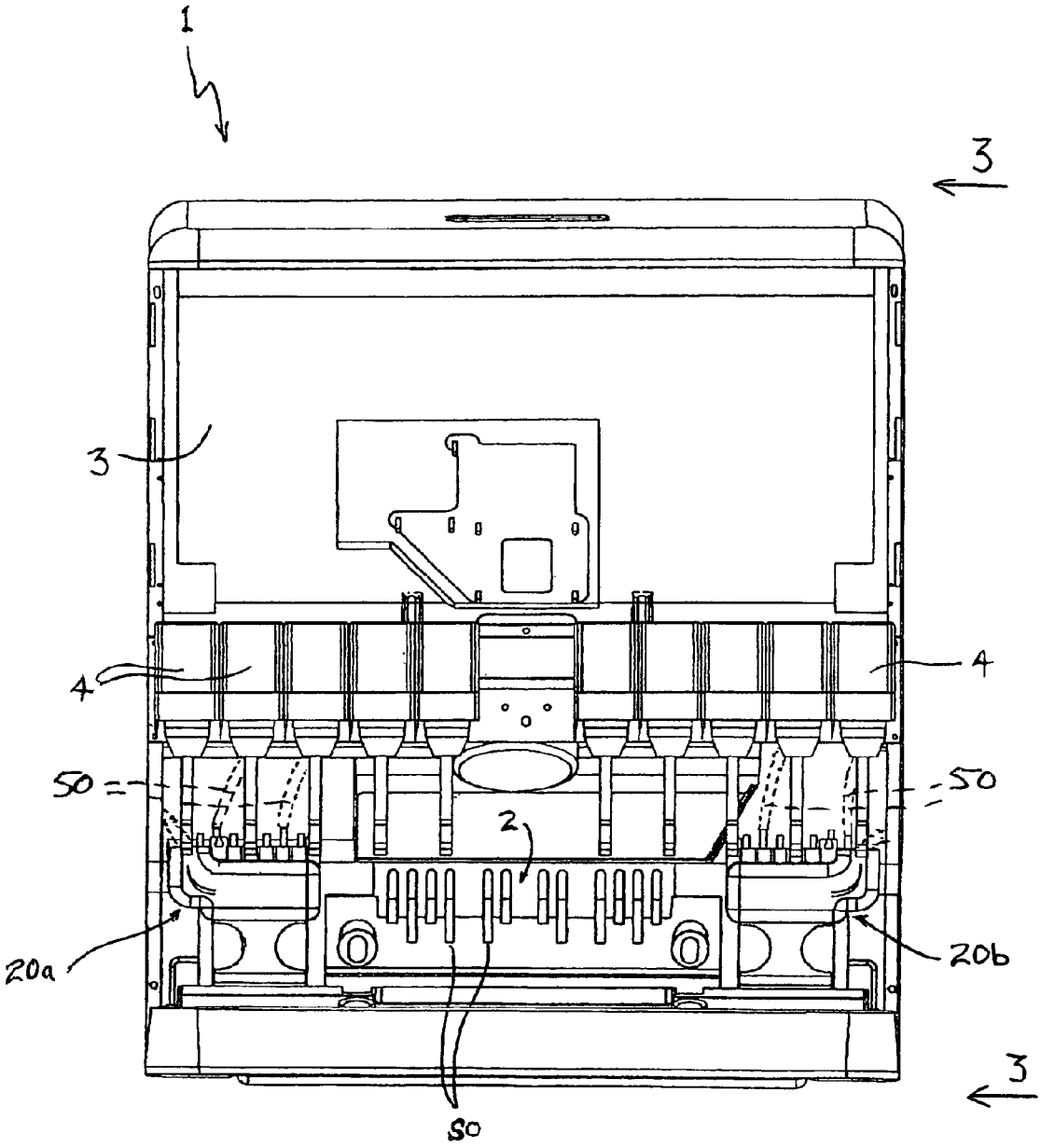
FIG. 2 shows a front plan view of the dispenser of FIG. 1 and having various components thereof removed.
Figure 3:
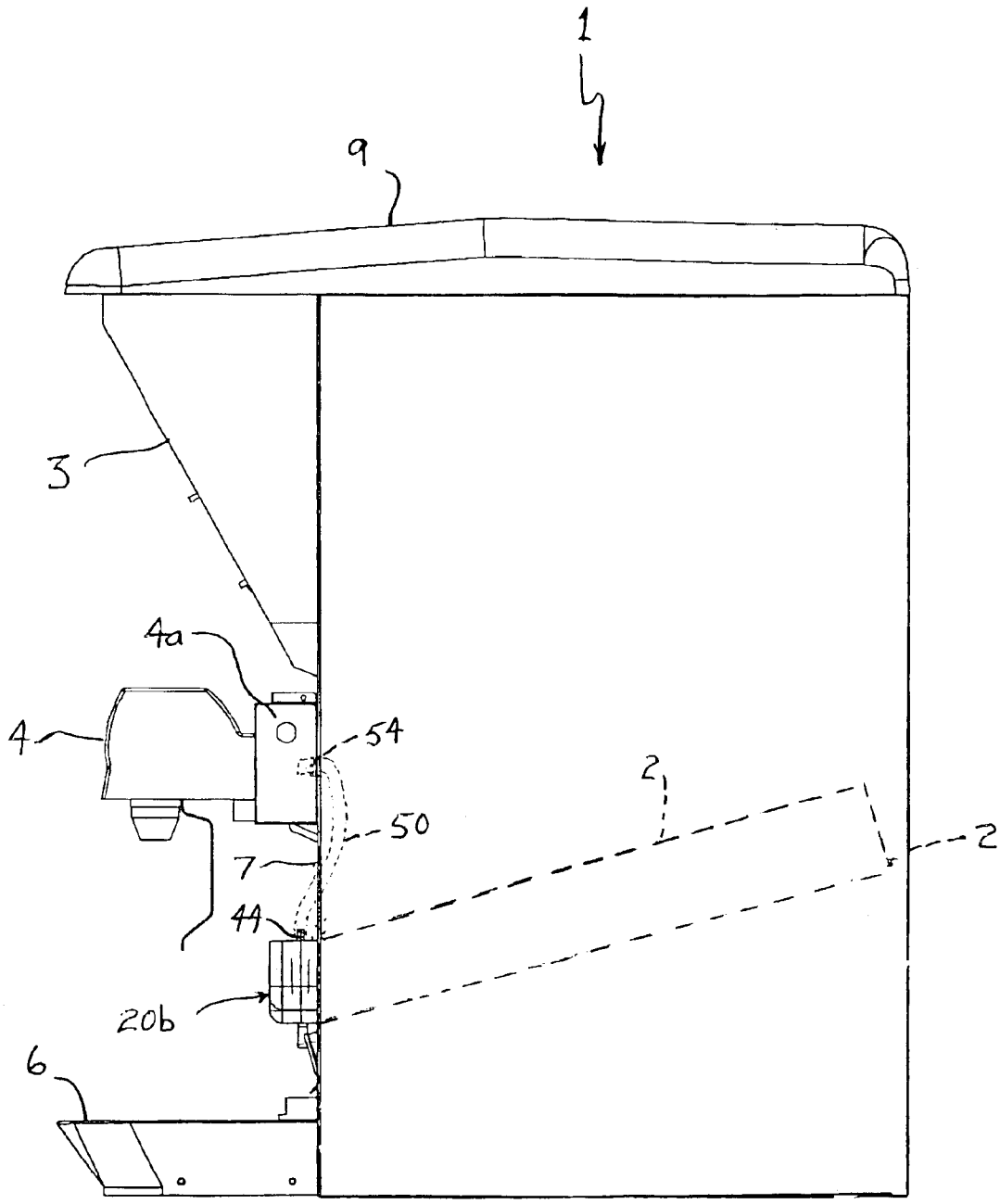
FIG. 3 shows a side plan view along lines 3—3 of FIG. 2.
Figure 4:
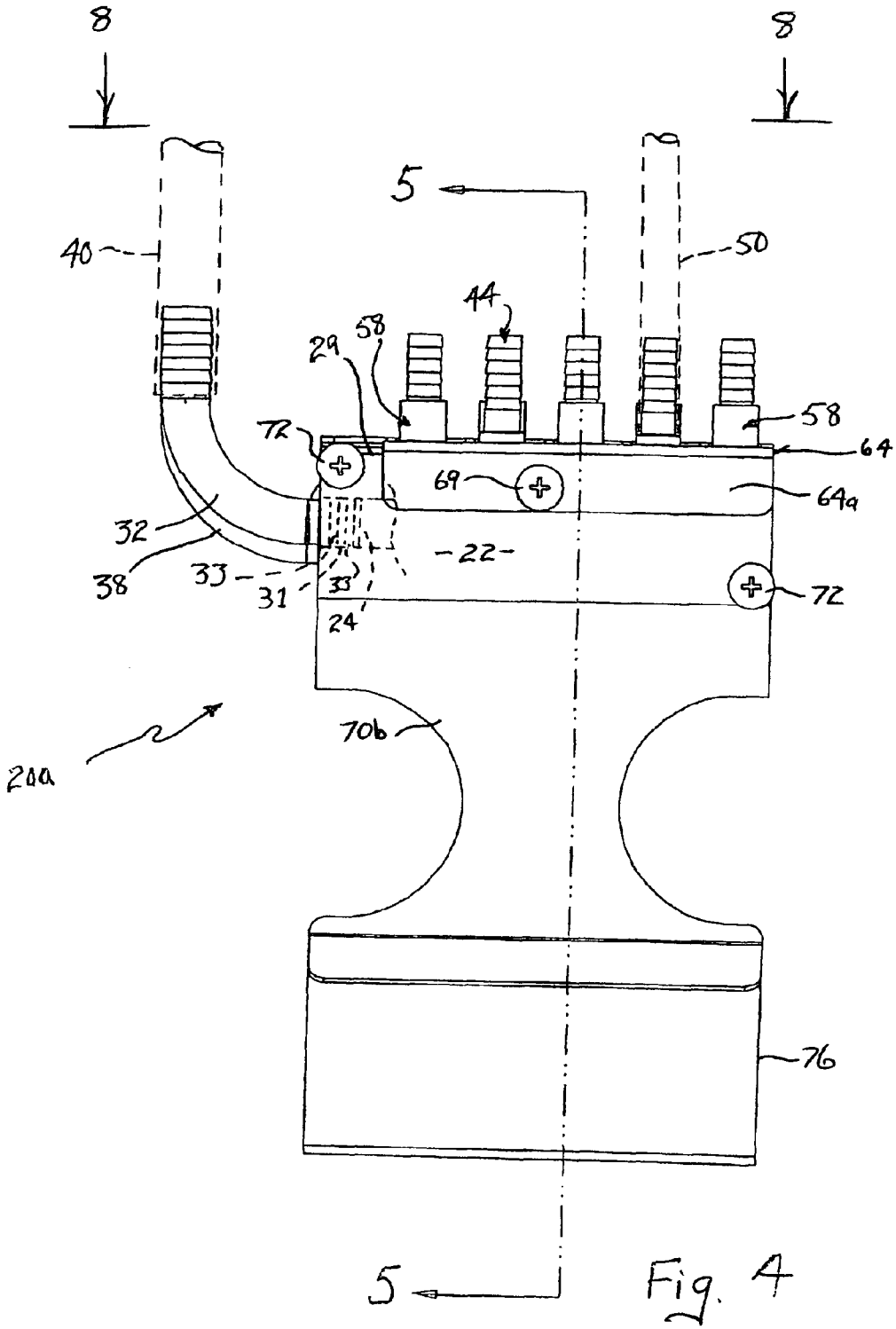
FIG. 4 shows an enlarged front plan view of a dual diluent manifold and associated mounting structure.
Figure 5:
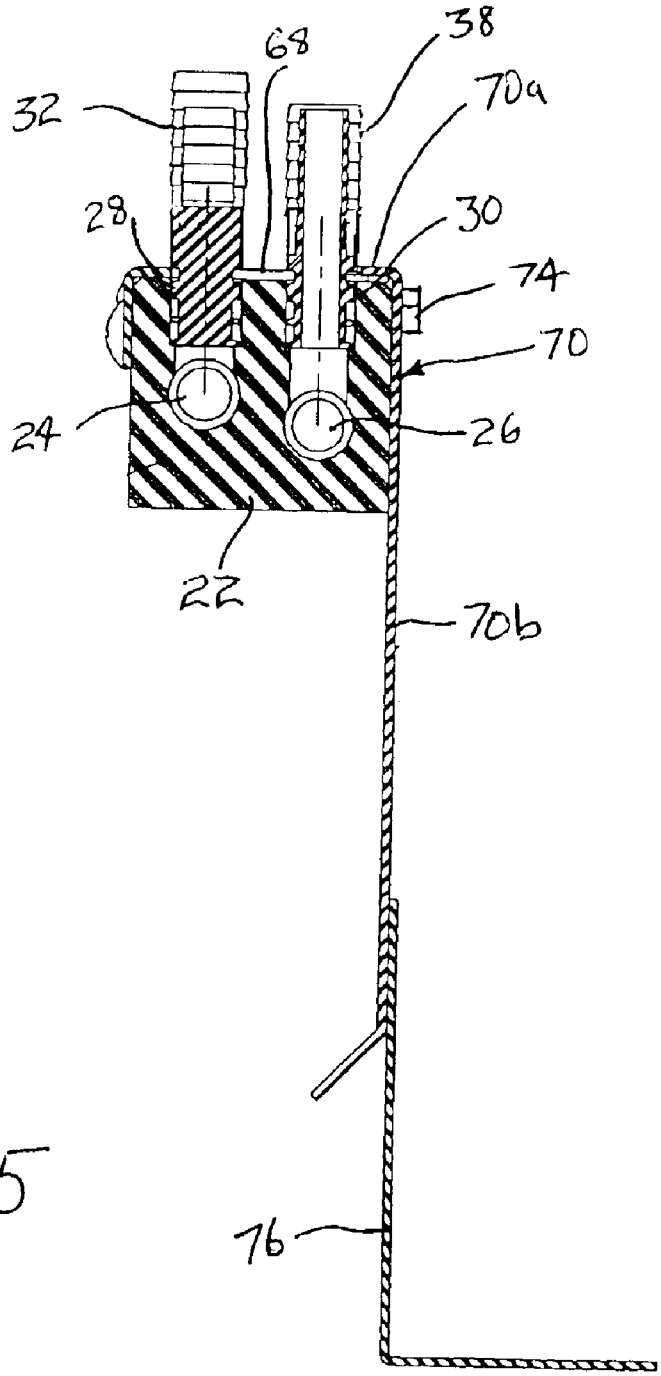
FIG. 5 shows an end a cross-sectional view of the manifold along lines 5—5 of FIG. 4.
Figure 6:
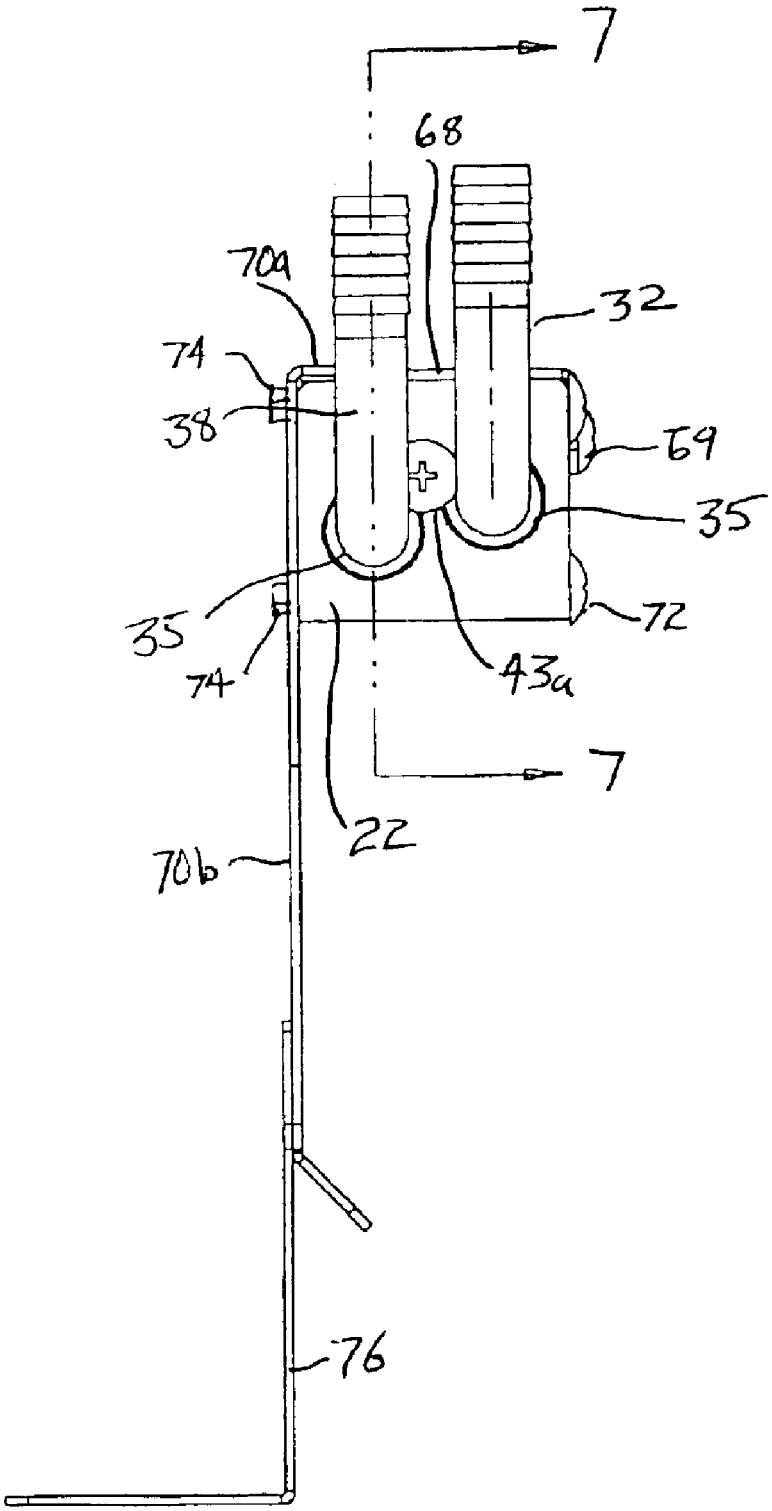
FIG. 6 shows an enlarged end plan view of the manifold.
Figure 7:
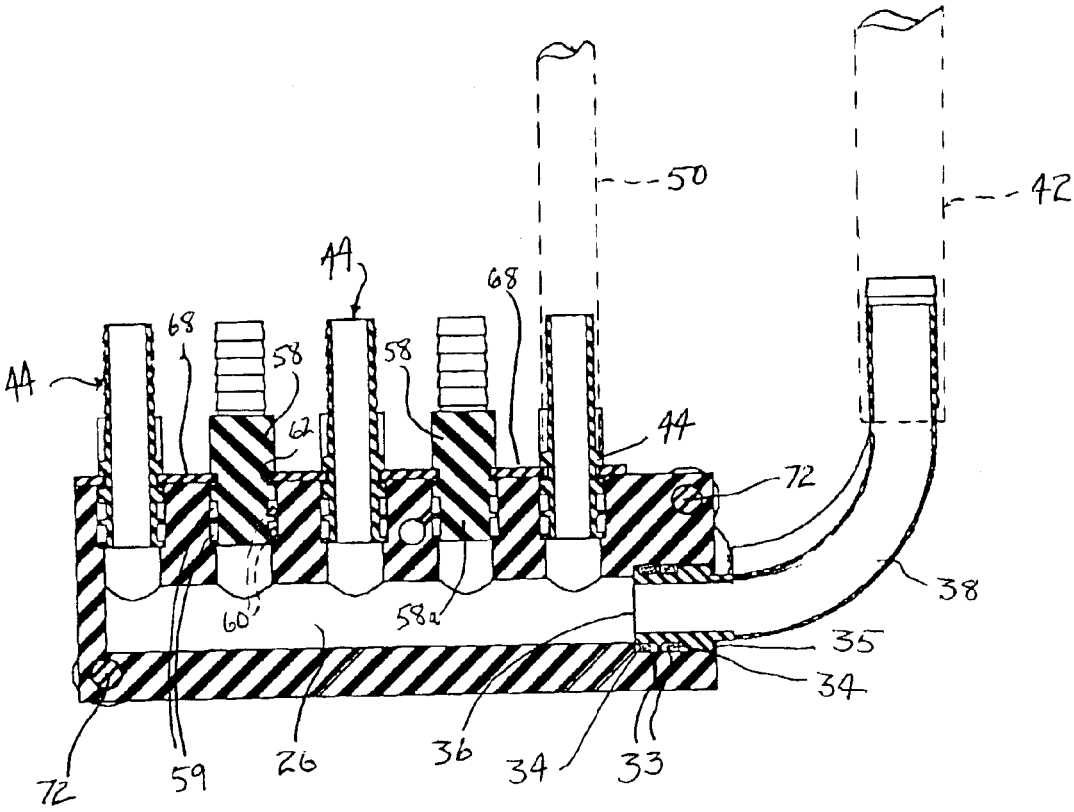
FIG. 7 shows a longitudinal cross-sectional view along lines 7—7 of FIG. 6.
Figure 8:
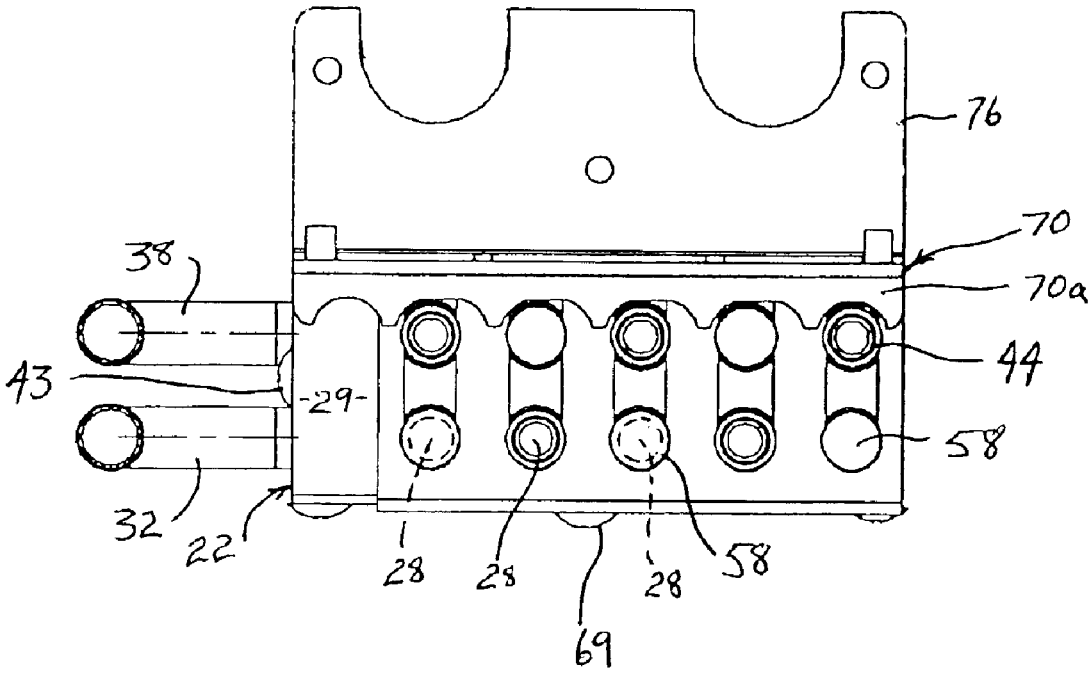
FIG. 8 shows a top plan view of the manifold along lines 8—8 of FIG. 4.

The change over device of the present invention is shown in the various figures in the context of an ice-cooled combination ice/beverage dispenser 1. As seen by specifically referring to FIGS. 1, 2, 3 and 11, and as is well understood in the art, dispenser 1 includes a cold plate 2 and an ice retaining bin 3 thereabove. A plurality of post-mix beverage dispensing valves 4 is secured to a front end thereof by valve disconnect blocks 4*a*. A more detailed understanding of the structure and operation of a post-mix valve and its mounting to a beverage dispenser can be had by referring, for example, to U.S. Pat No. 5,285,815 which is incorporated herein by reference thereto. An ice dispensing chute 5 is positioned between valves 4 and all are positioned above a drip tray 6. Dispenser 1 also includes a splash panel 7, a merchandiser cover 8 and a top cover 9.

Figure 11:
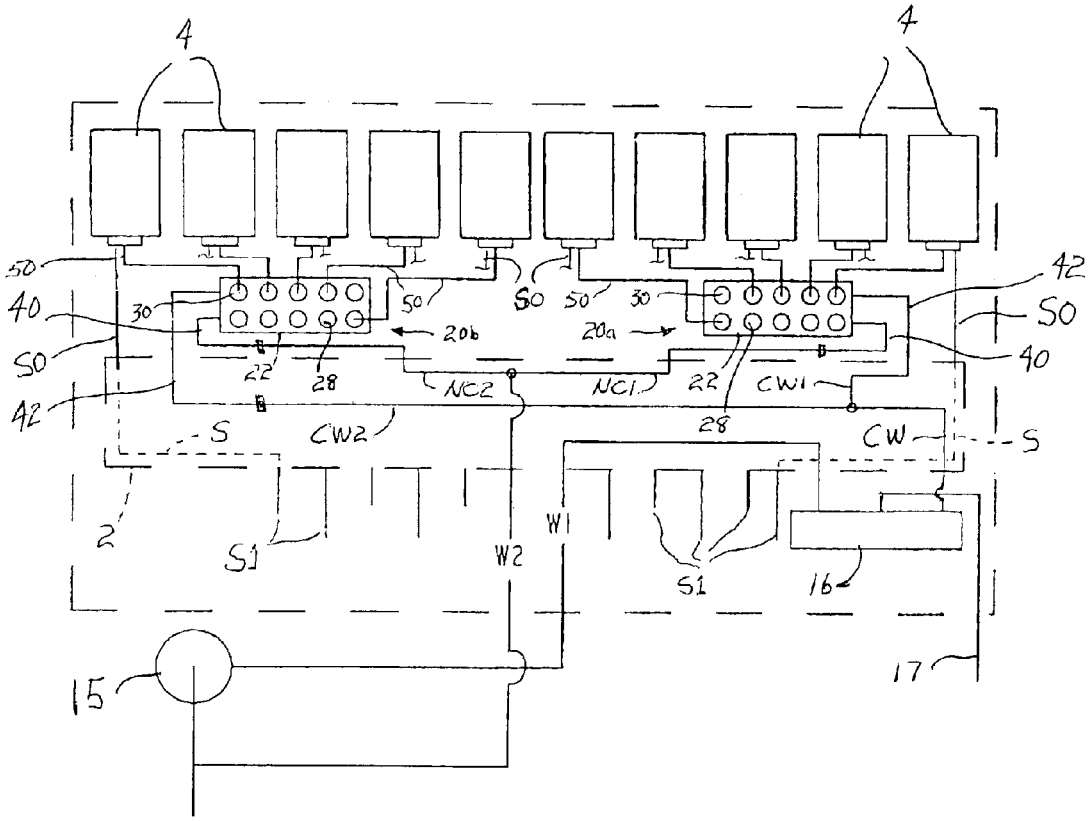
FIG. 11 shows a schematic diagram of the fluid connections of the present invention.

As is well known, and as understood by referring to FIG. 11, cold plate 2 includes a plurality of serpentine syrup and diluent heat exchange coils. Syrup coils S have a plurality of inlets S1 and outlet lines SO. Cold plate 2 also includes two water lines W1 and W2. Water line W1 receives potable water from a pump 15 connected to a mains water supply. Water flows along line W1 and is pre-cooled by passage through cold plate 2 and is then delivered to a carbonator 16. Pressurized carbon dioxide gas is supplied from a source thereof, not shown, to carbonator 16 through inlet 17 thereof. Carbonated water flows through a cold plate coil CW which then divides into two separate lines CW1 and CW2. Water line W2 is connected to the stated water mains directly and within cold plate 2 divides into two separate non-carbonated water lines NC1 and NC2. Syrup outlet lines SO are each connected to one of the valves 4.

Dispenser 1 includes a pair of dual diluent manifold systems generally designated by the numerals 20*a* and 20*b* and each having an exterior molded insulation cover 21*a* and 21*b* that can be opened in a clam-shell fashion. Systems 20*a* and 20*b* are identical right and left hand versions of the other. Thus, system 20*a* will be described in further detail with the understanding that the description thereof will apply equally to its mirror image counterpart 20*b*. As better understood by also referring to FIGS. 4–8, after removing insulation 21*a*, system 20*a* includes a rectangular dual diluent manifold block 22 having a plain water channel 24 and a carbonated water channel 26 extending therealong and therethrough. A plurality of plain water outlet retaining orifices 28 extend transversely from a top surface 29 of manifold block 22 and intersect with plain water channel 24. Likewise, an equal plurality of carbonated water outlet retaining orifices 30 extend from surface 29 transversely to and intersects fluidly with carbonated water channel 26. It can be seen that the plain and carbonated water outlet retaining orifices 24 and 26, respectively, form orifice pairs along manifold block 22. Plain water channel 24 includes an open inlet end 30 for fluid tightly receiving an inlet fitting 32. Fitting 32 includes a pair of annular grooves 33 for retaining a pair of O-rings 34 and a top shoulder surface 35. In the same manner, carbonated water channel 26 includes an inlet end 36 for receiving an inlet fitting 38 identical to fitting 32. Both fittings 32 and 38 are in turn connected to flexible hoses 40 and 42, respectively. Also, fittings 32 and 38 are retained in channel ends 30 and 36 by a self-threading screw 43 threaded into block 22 and including a screw head perimeter edge 43*a* for covering over a portion of each shoulder 35 of fittings 32 and 38 thereby retaining such in block 22. Hose 40 is fluidly connected to non-carbonated water line NC1 and hose 42 is fluidly connected to carbonated water line CW1. Those of skill will readily appreciate that hoses 40 and 42 could also be connected to plain water and carbonated water coils emanating from a cooled water bath of an electrically cooled beverage dispenser or to any sources of non-carbonated and carbonated water. Hoses 40 and 42 can also be insulated as by an insulating tape or wrap around the exterior thereof.

Figure 10:
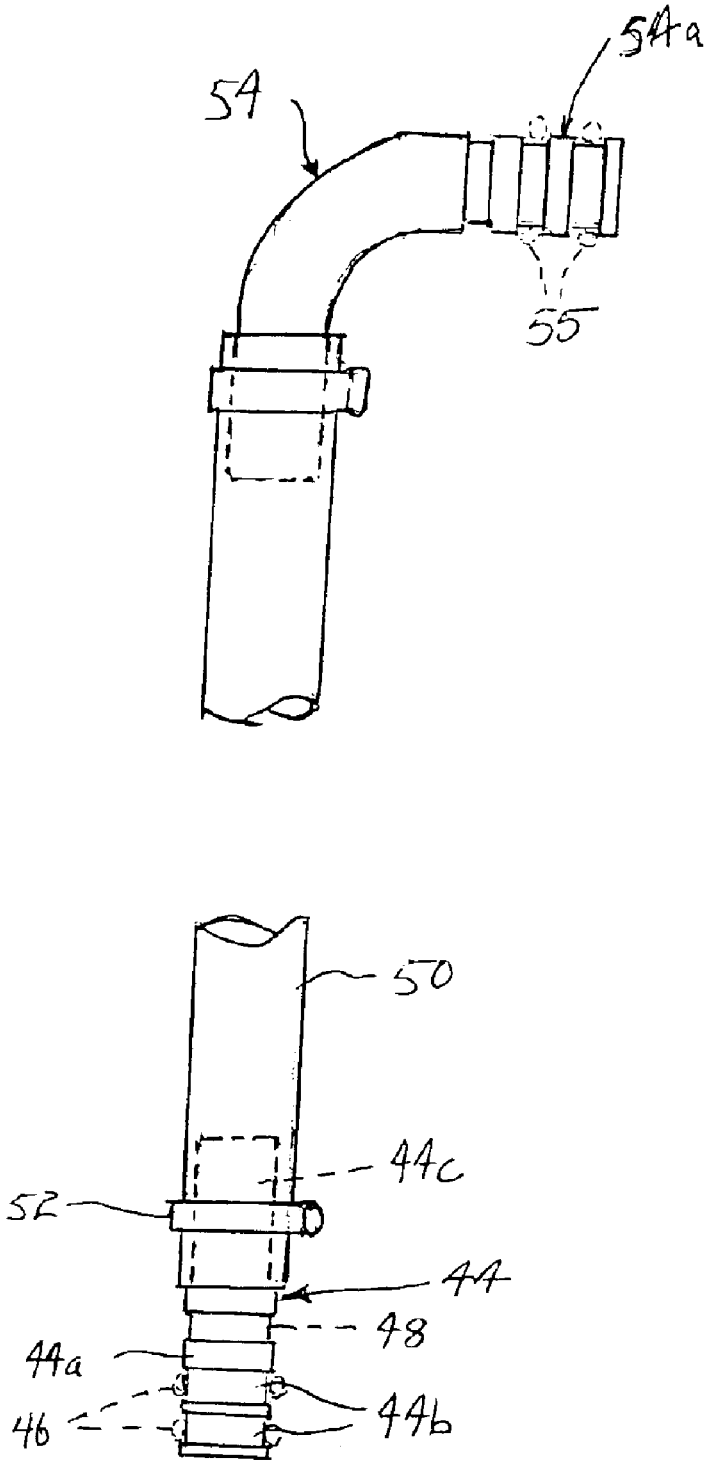
FIG. 10 shows a plan view of a water outlet and associated flexible diluent hose and post-mix valve inlet.

Outlet fittings 44 include an insertion end portion 44*a* having two annular grooves 44*b* for receiving O-rings 46 and includes an annular retainer groove 48. Fittings 44 also include a ferruled or barbed tube connection end portion 44*c*. As seen in FIG. 10, each outlet fitting 44 is secured by the connection end portion 44*c* to a flexible diluent hose 50 through the use of a suitable clamp or retaining band 52 Hose 50 is secured on its opposite end to a post-mix valve inlet fitting 54 also having a connection end portion 54*a* having annular grooves for retaining a pair of O-rings 55. As can also be well understood by referring to U.S. Pat No. 5,285,815, fitting 54 provides for fluid connection with one of the valves 4. A plurality of stop plugs 58 are solid structures having an end portion 58*a* that, like outlet fitting 44, includes annular grooves 59 for retaining a pair of O-rings 60 and includes an annular retaining groove 62. Hoses 50 can also be insulated.

Figure 9:
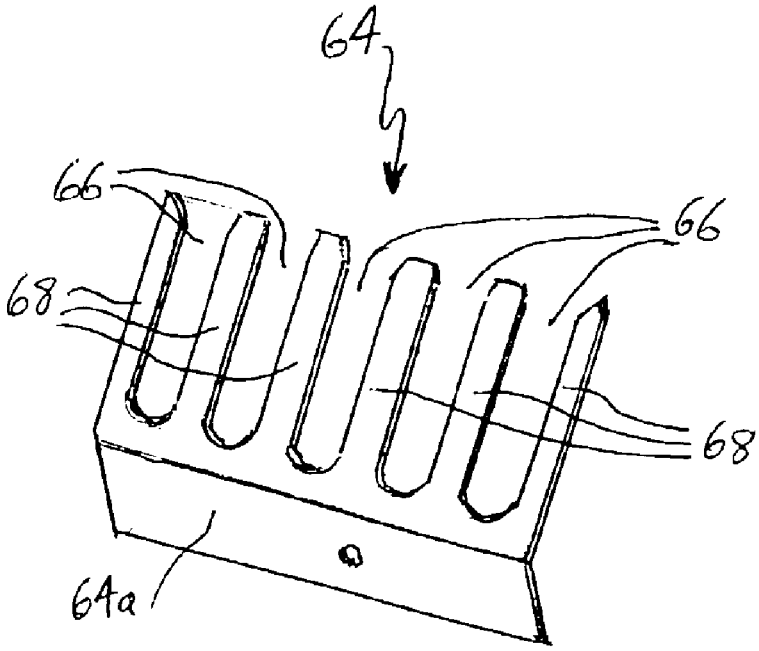
FIG. 9 shows a perspective view of the retaining plate.

Fittings 44 and stop plugs 58 are sized to be fluid tightly inserted into either of the equally sized plain water and carbonated water outlet orifices 28 and 30. When fully inserted therein, it can be understood that a retainer plate 64, see also seen in FIG. 9, is used to retain fittings 44 and plugs 58 in fluid tight securing position in their respective plain or carbonated water orifices 28 and 30. In particular, plate 64 is L-shaped having a vertical flange portion 64*a* and includes a plurality of slots 66 defined by fingers 68 extending transversely to flange portion 64*a*. Those of skill will understand that annular grooves 48 and 62 of outlet fittings 44 and stop plugs 58, respectively, receive portions of the perimeter edges of fingers 68. Thus, fingers 68 of retainer plate 64 can slide into grooves 48 and 62 once the slots 66 are registered with bodies of outlets 44 and stops 58. Plate 64 is then secured by a self-threading screw 69 to manifold block 22. With retaining plate 64 in place, as seen for example in FIG. 8, it will be appreciated that outlets 44 and plugs 58 can not be removed from manifold block 22. A further secondary retaining plate 70 includes a top horizontal portion 70*a* and a major bracket portion 70*b* integral therewith and extending downwardly therefrom and transversely thereto. Bracket 70 is secured to manifold block 22 by two bolts 72 extending through block 22 and through bracket portion 70 and retained thereto by nuts 74. When in position, top horizontal portion 70*a* of bracket 70 serves to cover and hold down tip ends of fingers 68 to provide for additional secure retaining thereof, and in turn, retaining of outlets 44 and stops 58. Bracket 70 can also be secured to a further retaining bracket 76 as may be needed to provide for the securing and support of each manifold system to dispenser 10.

In operation, those of skill will appreciate that by the removal of retaining bracket 64, outlets 44 and stops 58 can be quickly removed from their respective outlet orifices 28 and 30 in which they are inserted. Thus, one outlet 44 can, for example, be removed from a carbonated water orifice 30 and a stop 58 can be removed from the correspondingly paired plain water outlet orifice 28. After which, the relative positions thereof can exchanged whereby the outlet 44 is now in the plain water orifice 28 and the stop 58 is then placed in the corresponding carbonated water orifice 30. The retaining bracket 64 is then reinserted and secured to block 22. Those of skill will understand that all the valves 4 can be easily and quickly changed over between plain or carbonated water in this manner wherein the flexible tubing 50 provides for and facilitates the necessary movement. It can also be seen that the system of the present invention can be retrofitted to existing electrically and ice cooled beverage dispensers. In the illustrated embodiment, two manifold systems 20*a* and 20*b* are used wherein each manifold block 22 serves five of the ten valves. The number of manifolds and the number of valves served by each are a matter of design skill for those in the art. It can also be understood that the manifold system or systems of the present invention can be placed at various locations within a dispenser. The placement at the front of dispenser 1 is preferred due to the arrangement of the outlets from the cold plate 2 and access provided by the removable splash panel 8.

The present invention can also be used in any of a variety of general applications where either of two fluids is needed to be selectively sent to a mixing valve or outlet. In fact, it can be understood that block 22 could have any of a plurality of fluid channels connecting with one or more outlet orifices so that any of a plurality of diluents or specifically selected liquids could be selectively direct to one or more outlets, valves or the like.

What is claimed is:

1. A changeover system for delivering either of two liquid diluents to any of one or more beverage dispensing valves of a beverage dispensing machine, comprising: a manifold for being mounted to said dispenser and having a first channel for receiving a first liquid diluent and a second channel for receiving a second liquid diluent and one or more pairs of first and second liquid diluent outlet orifices, each said first outlet orifice being fluid coupled to said first channel and each said second outlet orifice being fluid coupled to said second channel so that the first diluent is delivered to each said first outlet orifice and the second diluent is delivered to each said second outlet orifice; one or more conduits, each for being coupled at one end to a diluent inlet to an associated beverage dispensing valve and each having an outlet fitting at an opposite end for releasable fluid coupling with either a first or second outlet orifice of a pair of orifices; and one or more stop fittings, each for releasable coupling with and for closing either a first or second outlet orifice of a pair of orifices, whereby a selected one of the first and second diluents may be delivered to any particular beverage dispensing valve by releasably fluid coupling said outlet fitting of the valve's associated conduit to either said first or second outlet orifice of a pair of orifices and releasably coupling a stop fitting with the other orifice of the pair to close the other orifice.

2. A changeover system as in claim 1, including means for insulating said manifold.

3. A changeover manifold as in claim 1, wherein said outlet fittings and said stop fittings are physically separate.

4. A changeover manifold as in claim 1, including means for insulating said one or more conduits.

5. A changeover manifold as in claim 1, including means for releasably retaining said one or more outlet fittings and stop fittings in said one or more manifold first and second orifices.

6. A system for delivering a selected one of two liquid diluents to a beverage dispensing valve of a beverage dispenser, comprising a manifold having first and second channels for connection with respective supplies of first and second liquid diluents and first and second diluent outlets at a surface of said manifold that respectively connect with said first and second channels so that the first diluent is provided at said first outlet and the second diluent is provided at said second outlet; diluent delivery means for releasable connection with a selected one or the other of said first or second diluent outlets for receiving and delivering to the beverage dispensing valve the diluent provided at said selected outlet; and a stop member separate from said diluent delivery means for releasable connection with the non-selected diluent outlet to close said non-selected outlet.

7. A system as in claim 6, wherein said diluent delivery means and said stop member are physically separate.

8. A system as in claim 6, including means for releasably maintaining the connection of each of said diluent delivery means and said stop member with said first and second outlets.

9. A system as in claim 6, wherein said diluent delivery means and said stop member each have at least one recess and said releasably maintaining means comprises a bracket having tines at least one of which is adapted to be extended into said recesses in said diluent delivery means and stop member, and means for releasably attaching said bracket to said manifold.

10. A system for delivering a selected one of two liquid diluents to any of a plurality of beverage dispensing valves, comprising a manifold having first and second channels, respective first and second inlets to said channels for connection with respective supplies of first and second liquid diluents, and a plurality of pairs of first and second diluent outlets that respectively connect with said first and second channels so that the first diluent is provided at each said first outlet and said second diluent is provided at said each second outlet; a plurality of flexible conduits each for being coupled at one end to a diluent inlet to an associated beverage dispensing valve and having at an opposite end a connector for releasable connection with a selected one of said first and second diluent outlets of an associated pair of outlets for receiving and delivering to its associated beverage dispensing valve the diluent provided at said selected outlet; and a plurality of stop members separate from said flexible conduit connectors, each said stop member for releasable connection with and for closing the non-selected diluent outlet of an associated pair of outlets.

11. A system as in claim 10, wherein said conduit connectors and said stop members are physically separate.

12. A system as in claim 10, including a bracket for releasable connection to each of said manifold, said conduit connectors and said stop members to releasably maintain the connection of said conduit connectors and stop members with their associated outlets.

13. A system as in claim 12, wherein said hose connectors and said stop members each include a recessed portion and said bracket includes a bifurcated portion defining tines that are extendable into said recessed portions.

14. A system as in claim 10, including means for insulating said manifold.

15. A system for delivering a selected one of two liquid diluents to individual ones of multiple beverage dispensing valves of a beverage dispenser, comprising a manifold for being mounted on the dispenser and having multiple pairs of first and second diluent outlets; means for delivering a first liquid diluent to each said first outlet and a second liquid diluent to each said second outlet; means for selectively releasably coupling one of said first or second outlet of each pair of outlets to an associated beverage dispensing valve to deliver to the associated beverage dispensing valve either the first or second diluent; and stop member means for releasable coupling with and closing each non-selected first and second outlet that is not fluid coupled with an associated beverage dispensing valve, said stop member means being separate from said means for coupling.

16. A system as in claim 15, wherein said means for coupling and said stop member means are physically separate.

17. A method of delivering a selected one of two liquid diluents to a beverage dispensing valve of a beverage dispenser, comprising the steps of mounting a manifold on the beverage dispenser; providing first and second channels in the manifold; connecting the first and second channels to respective supplies of first and second liquid diluents; coupling the first and second channels to respective first and second diluent outlets at a surface of the manifold so that the first diluent is provided at the first outlet the second diluent is provided at the second outlet; providing a conduit for delivery of diluent to the beverage dispensing valve; releasably coupling a connector at an end of the conduit to a selected one of the first and second diluent outlets to deliver the first or second diluent to the beverage dispensing valve; and releasably connecting a stop member that is separate from the conduit connector to the non-selected outlet to close the outlet.

18. A method as in claim 17, wherein said step of releasably connecting a stop member comprises releasably connecting a stop member that is physically separate from the conduit connector.

19. A method as in claim 17, including the further steps of uncoupling the conduit connector from the selected one of the first and second diluent outlets and disconnecting the stop member from the non-selected outlet; and then releasably coupling the conduit connector to the initially non-selected outlet and releasably connecting the stop member to the initially selected outlet to change the diluent delivered to the beverage dispensing valve.

20. A method as in claim 19, wherein said step of connecting the stop member to the initially selected outlet orifice comprises connecting to the initially selected outlet orifice a stop member that is physically separate from the conduit connector.

21. A method as in claim 17, including the step of insulating at least the manifold.

22. A method as in claim 17, including the step of releasably connecting a retainer to each of the connector, stop member and conduit connector.

23. A method of delivering a selected one of two liquid diluents to individual ones of a plurality of beverage dispensing valves, comprising the steps of providing first and second channels in a manifold; connecting the first and second channels to respective supplies of first and second liquid diluents; connecting the first and second channels to respective first and second diluent outlets of a plurality of pairs of first and second diluent outlets at a surface of the manifold so that the first diluent is provided at each first outlet and the second diluent is provided at each second outlet; establishing fluid paths between diluent inlets to individual ones of the beverage dispensing valves and selected ones of the first and second diluent outlets of associated pairs of outlets to deliver to individual ones of the beverage dispensing valves the diluents provided to the associated selected outlets; and releasably connecting individual ones of a plurality of stop members with the non-selected diluent outlets to close the outlets, the stop members being separate from the fluid paths.

24. A method as in claim 23, wherein said step of releasably connecting the stop members comprises releasably connecting stop members that are physically separate from the fluid paths.

25. A method as in claim 23, including the further steps of interrupting the fluid path from a selected one of the diluent outlets to its associated beverage dispensing valve; disconnecting the stop member from the non-selected outlet associated with the beverage dispensing valve; and then establishing a fluid path from the initially non-selected outlet to the beverage dispensing valve and connecting the stop member to the initially selected outlet to change the diluent delivered to the beverage dispensing valve.

26. A method as in claim 25, wherein said step of connecting the stop member to the initially selected outlet comprises connecting to the initially selected outlet a stop member that is physically separate from the fluid path.

27. A method of delivering a selected one of two liquid diluents to a beverage dispensing valve of a beverage dispenser, comprising mounting a manifold on the dispenser, the manifold having a pair of liquid diluent outlets; delivering a first liquid diluent to a first one of the outlets and a second liquid diluent to a second one of the outlets of the pair; releasably fluid coupling a selected one of the first and second outlets to a diluent inlet to the beverage dispensing valve to deliver to the beverage dispensing valve the first or second liquid diluent; releasably closing the non-selected first or second outlet, wherein said releasably fluid coupling and releasably closing steps are performed separately; and changing the diluent delivered to the beverage dispensing valve by performing the further steps of uncoupling the beverage dispensing valve from the selected first or second outlet; unclosing the non-selected outlet; releasably fluid coupling the previously non-selected outlet to the diluent inlet to the beverage dispensing valve; and releasably closing the previously selected outlet.

* * * * *